United States Patent [19]

Heard et al.

[11] 4,300,291

[45] Nov. 17, 1981

[54] METHODS AND APPARATUS FOR HEATING PARTICULATE MATERIAL

[75] Inventors: Harold Heard; Charles R. Wilt, both of Pittsburgh, Pa.

[73] Assignee: Salem Corporation, Pittsburgh, Pa.

[21] Appl. No.: 131,057

[22] Filed: Mar. 17, 1980

Related U.S. Application Data

[63] Continuation-in-part of Ser. No. 20,168, Mar. 13, 1979, Pat. No. 4,236,318.

[51] Int. Cl.[3] ..... F26B 3/08; F26B 17/00; F27B 15/00

[52] U.S. Cl. ..... 34/10; 34/57 A; 432/15; 432/58

[58] Field of Search ..... 34/10, 57 A; 432/15, 432/58

[56] References Cited

U.S. PATENT DOCUMENTS

| | | | |
|---|---|---|---|
| 2,132,656 | 10/1938 | Smith | 34/34 |
| 2,666,269 | 1/1954 | Parry | 34/10 |
| 3,212,197 | 10/1965 | Crawford | 34/10 |
| 3,591,928 | 7/1971 | Nara | 34/10 |
| 3,687,431 | 8/1972 | Parks | 34/10 |
| 3,773,892 | 11/1973 | Reimann | 423/171 |
| 3,800,427 | 4/1974 | Kemmetmueller | 34/10 |
| 3,985,517 | 10/1976 | Johnson | 34/10 X |
| 4,043,049 | 8/1977 | Hedstrom | 34/10 |
| 4,153,427 | 5/1979 | Bissett et al. | 34/10 |
| 4,245,395 | 1/1981 | Potter | 34/10 |

*Primary Examiner*—John J. Camby

*Attorney, Agent, or Firm*—Buell, Blenko, Ziesenheim & Beck

[57] ABSTRACT

A method and apparatus are provided for heating and/or drying particulate materials such as coal wherein the particulates are fed into a direct heating fluidizing chamber, carried in a stream of heated oxygen-free gas at a temperature sufficiently high to heat the particles to a preselected temperature. The particles are then removed from the gas stream at the preselected temperature and then the gas is reheated in a heat exchanger and recycled. Where the particulate material to be dried yields a vapor, such as steam, the vapor is used as the transport or fluidizing gas. Means are provided for removing and/or condensing such vapor beyond the amount needed for fluidization.

10 Claims, 2 Drawing Figures

METHODS AND APPARATUS FOR HEATING PARTICULATE MATERIAL

This application is a continuation-in-part of our copending application Ser. No. 020,168, filed Mar. 13, 1979 now U.S. Pat. No. 4,236,318 granted Dec. 2, 1980.

This invention relates to methods and apparatus for heating particulate material and particularly to a method and apparatus for heating and drying finely divided coal and similar particulate materials in a directly heated fluidized bed prior to subsequent use or further processing.

In the processing of many materials there is frequently a stage where it is necessary or desirable to preheat the material in finely divided pariculate form. This is true of many polymers, mineral solids and organic solids such as coal. Coal is a particularly good example of such materials and is particularly pertinent at the present time because of the need to conserve liquid and gaseous hydrocarbons and to substitute in their stead coal as a source of energy. Coal, particularly when very finely divided, must be carefully handled because of the danger of explosions which occur in the presence of free oxygen in the coal heating and/or drying atmosphere. This is equally true of other finely divided oxidizable materials such as plastics, etc.

There have been various proposals made for drying coal and other fine particulate materials. Typical of prior art patents dealing with this subject are:

| | | |
|---|---|---|
| U.S. Pat. No. 2,833,055 | Wright | May 6, 1958 |
| U.S. Pat. No. 2,956,347 | Gordon | October 18, 1960 |
| U.S. Pat. No. 3,190,867 | Oldweiler | June 22, 1965 |
| U.S. Pat. No. 3,192,068 | Brandt | June 29, 1965 |
| U.S. Pat. No. 3,212,197 | Crawford | October 19, 1965 |
| U.S. Pat. No. 3,218,729 | Micklich | November 23, 1965 |
| U.S. Pat. No. 3,238,634 | Goins | March 8, 1966 |
| U.S. Pat. No. 3,250,016 | Agarwal | May 10, 1966 |
| U.S. Pat. No. 3,309,780 | Goins | March 21, 1967 |
| U.S. Pat. No. 3,339,286 | Stephanoff | September 5, 1967 |
| U.S. Pat. No. 3,699,662 | Stephanoff | October 24, 1972 |
| U.S. Pat. No. 3,800,427 | Kemmetmueller | April 2, 1974 |
| U.S. Pat. No. 3,805,401 | Fontein | April 23, 1974 |
| U.S. Pat. No. 3,823,487 | Cherry | July 16, 1974 |
| U.S. Pat. No. 3,879,856 | Barr | April 29, 1975 |
| U.S. Pat. No. 3,884,620 | Rammler | May 20, 1975 |
| U.S. Pat. No. 3,896,557 | Seitzer | July 29, 1975 |
| U.S. Pat. No. 3,921,307 | Marek | November 25, 1975 |
| U.S. Pat. No. 4,043,049 | Headstrom | August 23, 1977 |
| U.S. Pat. No. 4,153,427 | Bissett et al. | May 8, 1979 |

These patents show various drying processes for pulverulent or granular material in which the pulverulent or granular material is fluidized in a flowing stream of gas which may include or may be in entirety the vaporized liquid contaminant itself. The patents in which this is disclosed are basically patents for the treatment of polymer materials and coal in which an organic liquid contaminant or water is being removed. The patents are in general much more complex and expensive in structure and operation than is the present invention and have generally not been adopted to any extent in the trade, to our knowledge.

Of the foregoing patents the Bissett el al. U.S. Pat. No. 4,153,427, the Kemmetmueller U.S. Pat. Nos. 3,800,427 and Crawford 3,212,197 are perhaps the most pertinent. The Bissett et al. patent is directed to a process in which the coal is first formed into a slurry and then sprayed into a concurrently introduced stream of superheated steam through a nozzle at the bottom of a vertical tower. This of course involves the expense of slurrying, of pressurizing and spraying. Kemmetmueller is, on the other hand, essentially tied to sulfur removal of coking coal and requires the simultaneous introduction of inert gas and steam to dry the coal and remove sulfur. It is a relatively complex operation and is not satisfactory for general heating or drying of particulate materials. In Kemmetmueller substantial amounts of sulfur containing gases are evolved and must be treated and there is no recycling of the transport fluid. Crawford is similarly quite complex and involves the use of a scrubber to scrub the transport gas to remove extraneous vapors and to control the system pressure. Such a system is structurally complex and expensive to operate and produces a large volume of scrubber waste which must be purified or it becomes an environmental pollutant.

We have invented a method of drying and/or heating particulate materials which depends upon using a recirculating condensible fluid such as steam preferably evolved from the coal itself to provide a fluidized bed of particulates being heated by a direct contact heating arrangement and a recovery means for removing particulates which have been heated and/or dried to a preselected level.

Where a condensible gas or vapor is released in the heating and/or drying step, the vapor becomes the transport media and means are provided for maintaining the temperature of such gas or vapor and for removing that portion which is in excess of that needed to carry the particulates in the fluidized bed. Thus, in this application, when we speak of an inert or "oxygen free" gas we mean a gas which is free of oxygen in quantities that will have a deleterious effect on the product.

Preferably we provide a method which comprises the steps of delivering a particulate material to be heated and/or dried to a fluidizing chamber, fluidizing and heating said particulate material with an upwardly flowing stream of heated gas at a temperature sufficient to raise the temperature of the particulate material to a preselected level and at a flow rate sufficient to fluidize and/or transport the particulate material, indirectly heating said particulate material and gas by contact with a solid heating means, such as a radiant heat tube, in said fluidizing chamber, removing said heated particulate material from the fluidized bed, partially reheating at least a portion of the gas in a heat exchanger and recycling the same into the fluidized bed whereby the fluidizing gas is continuously recirculated. Preferably, if the particulate material is wet and generates gas vapors during heating, e.g. steam, in the case of water washed coal particulates, the vapors are used as the inert transport gas for the fluidized bed and means are provided for removing and condensing the excess vapors. Where the particulate material fed to the system is completely dry, a suitable vapor may be added to make up any lost from the system when the heated removed particulates.

In the case of coal this practice is highly environmentally protective because only heated coal and water are removed. If the water is "dirty" it is much easier to handle and clean than is dirty gas.

In this application the term "indirectly heating" means heating the fluidized bed with a solid heating means extending into or through the bed such as radiant heat pipes, heating coils and the like.

In the foregoing general description of our invention we have set out certain objects and advantages; however, other objects, purposes and advantages will be apparent from a consideration of the following description and the accompanying drawings in which.

Figure 1:
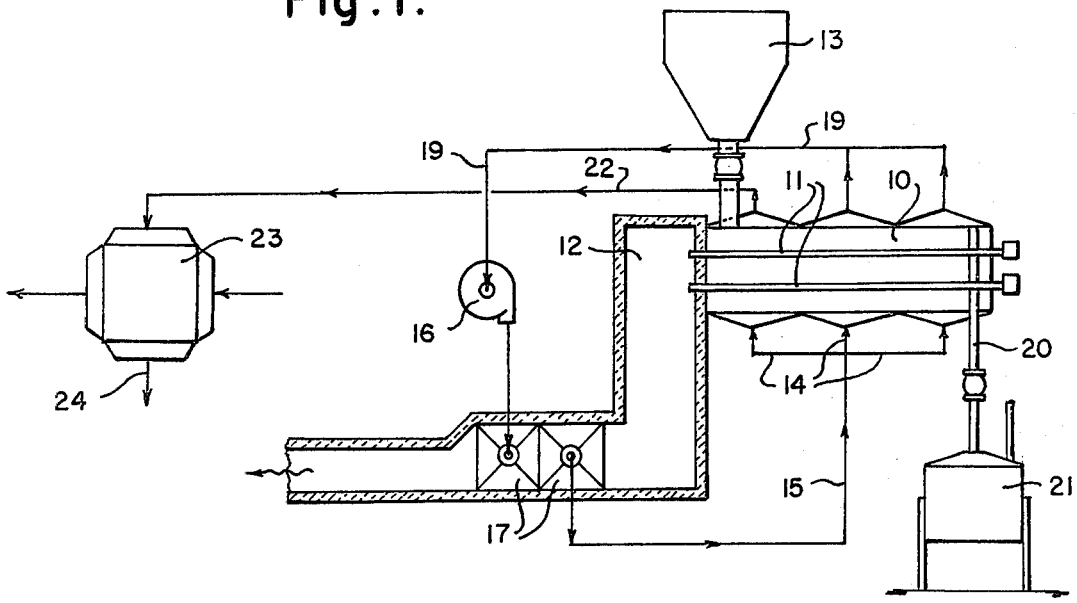
FIG. 1 is a schematic flow sheet of our process for heating particulates.

Referring to the drawings, we have illustrated an elongate horizontal fluidizing and heating chamber 10 having radiant burner tubes 11 extending lengthwise through chamber 10 and discharging into a refractory lined superheated chamber 12 at one end of chamber 10. A particulate feeder 13 is provided delivering solid particulate material to be heated into said heating chamber 10 adjacent one end. A plurality of gas inlet lines 14 from gas manifold line 15 deliver fluidizing gas from the end of chamber 10 remote from feeder 13 through recirculating fan 16. Preferably the recirculated gas is removed from chamber 10 by line 19 and passed through superheater tubes 17 in superheater chamber 12 where the recirculated gas is heated by flue gases from radiant heaters 11 before the flue gases discharge to stack. The heated, dried particulate material is removed from chamber 10 by discharge line 20 which delivers the particulate material to a collection chamber 21. Excess steam is removed from chamber 10 by bleeder line 22 and delivered to condenser 23 where it is cooled, condensed and discharged as dirty water from line 24.

Figure 2:
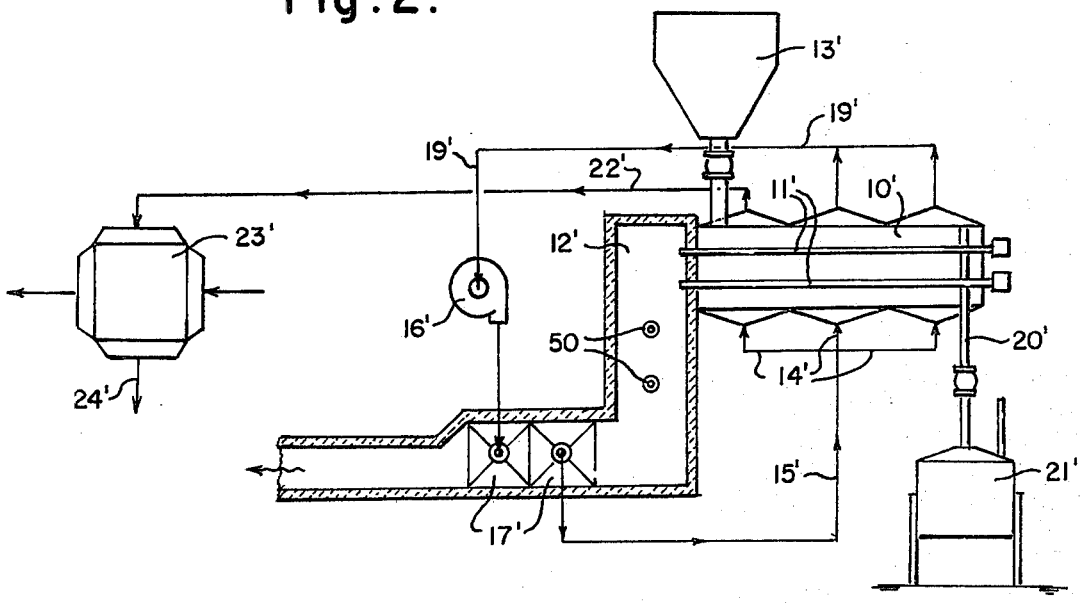
FIG. 2 is a schematic flow sheet of our process for heating and drying particulates including recirculation and reheating of a portion of vapor using auxiliary burners.

In the embodiment illustrated in FIG. 2 we have illustrated essentially the same arrangement but designed for adding additional superheat to the exhaust gas for superheating the recirculated gases by the use of auxiliary burner 50. In this embodiment those elements which are the same as elements in FIG. 1 will bear like numbers with the prime suffix and the operation will be described in connection with drying of fine particle coal as representative of such materials. The coal fines are delivered to fluidizing and heating chamber 10' by feeder 13' where they are fluidized by high temperature steam from superheater 17' entering chamber 10' through lines 14' and manifold 15'. The wet coal particles are fluidized and heated and the water is vaporized and part joins the transport stream in line 19' and part is exhausted by line 22' to condenser 23'.

The heated and dried fluidized coal particles are carried to collection chamber 21'. A bleeder line 22' from chamber 10' removes a portion of the gas from the system generally equal to that produced by the drying and heating of the coal and delivers it to condenser 23' where it is condensed to liquid and passed out of the system through line 24' to discharge or to a cleaner if necessary. The non-condensible gases may be collected and passed similarly.

The structure and process of this invention has numerous advantages. It is simple yet highly efficient. By using steam or other non-combustible gas as the fluidizing agent it eliminates the danger of explosion common to finely divided organic particulate material. It is environmentally desirable since it eliminates all gaseous wastes which are difficult to clean. Non-condensible gases produced in the heating or drying are not contaminated with products of combustion as in a direct fired dryer or heater and means may be provided for separating condensible from non-condensible gases. This may include a condenser or similar apparatus for removing the condensible gases from the non-condensible gases. It is extremely economical in energy consumption.

In the foregoing specification we have set out certain preferred embodiments and practices of our invention; however, it will be understood that this invention may be otherwise embodied within the scope of the following claims.

We claim:

1. The method of heating and drying a particulate material comprising the steps of:

(a) delivering a particulate material to be heated to one end of an elongate horizontally extending fluidizing and heating chamber whose length is substantially greater than its height;

(b) fluidizing and heating said particulate material with an upwardly flowing stream of oxygen-free gas separately introduced into said chamber at spaced areas along its length, transverse to the length of said fluidizing chamber at a temperature sufficient to raise the temperature of the particulate material to a preselected level for drying and at a flow rate sufficient to fluidize and/or transport the particulate material;

(c) heating said gas and particulate material in said fluidizing and heating chamber by radiant heating means extending the length of said chamber intermediate the top and bottom on opposite sides of the longitudinal center line in the path of said fluidized particulate material to maintain the desired temperature level;

(d) removing said heated and dried particulate material from the fluidized bed or transport stream at the other end of said chamber;

(e) removing gases substantially equivalent to the amount of gases formed from the drying of the particulate material; and (f) recycling said oxygen-free gas into said fluidizing chamber whereby particulate material is continuously fluidized, heated and transported out of said fluidized bed.

2. The method as claimed in claim 1 wherein the oxygen-free gas is reheated in a heat exchanger during recirculation at least in part by exhaust gases from the radiant heating means.

3. The method as claimed in claims 1 or 2 wherein the particulate material is coal and the inert gas is steam.

4. The method as claimed in claims 1 or 2 wherein the recyclced oxygen-free gas is passed through a superheater heated by exhaust gases from the radiant heating means and by auxiliary heaters combined therewith.

5. The method as claimed in claim 3 wherein the recycled steam is passed through a superheater heated by exhaust gases from the radiant heating means and by auxiliary heaters combined therewith.

6. Apparatus for heating and drying particulate material comprising a generally horizontally extending elongate fluidizing chamber having a top and bottom and two spaced ends whose length is substantially greater than its height, particulate material feed means delivering particulate material into said fluidizing chamber adjacent one end, means for separately introducing a heated oxygen-free gas into said fluidizing chamber adjacent its bottom at spaced areas along its length and transverse to its length at a temperature sufficient to raise the particulate material to a preselected temperature for drying and at a flow rate sufficient to fluidize and/or transport said particulate material, radiant heating means extending lengthwise through said heating chamber intermediate the top and bottom on opposite sides of the longitudinal center line in the path of the fluidized particulate material for heating said oxygen-free gas, separating means adjacent the other end of said fluidizing chamber receiving fluidized dried and heated particulate material and separating the same from said gas, bleeder means for removing a selected amount of gas following said separating heat exchanger means receiving at least a portion of the gas from said other end for reheating the same and means for connecting said heat exchanger means to the means for delivering gas to the fluidizing chamber.

7. An apparatus as claimed in claim 6 including condenser means connected with the bleeder means for condensing any condensible gas to a liquid.

8. An apparatus as claimed in claim 6 or 7 wherein the oxygen-free gas is steam.

9. An apparatus as claimed in claim 6 or 7 or 8 wherein the heating means is radiant heat tubes extending through said chamber, a superheat chamber receiving exhaust gases from said radiant tubes for super-heating the recycled gas is provided, and the heated oxygen-free gas is introduced at a plurality of spaced points along the length of said chamber.

10. An apparatus as claimed in claim 9 wherein auxiliary heat means are provided in said superheat chamber.

* * * * *

UNITED STATES PATENT AND TRADEMARK OFFICE

CERTIFICATE OF CORRECTION

PATENT NO. : 4,300,291

DATED : November 17, 1981

INVENTOR(S) : HAROLD HEARD and CHARLES R. WILT

It is certified that error appears in the above-identified patent and that said Letters Patent are hereby corrected as shown below:

Column 1, line 16, "pariculate" should read --particulate--.

Column 3, line 14, "superheated" should read --superheater--.

Claim 4, column 4, line 48, "recyclced" should be --recycled--.

Signed and Sealed this

*Twenty-third* Day of *March 1982*

[SEAL]

*Attest:*

GERALD J. MOSSINGHOFF

*Attesting Officer*

*Commissioner of Patents and Trademarks*